US005919320A

United States Patent [19]

Agarwal et al.

[11] Patent Number: 5,919,320

[45] Date of Patent: Jul. 6, 1999

[54] NICKEL-FREE WHITE GOLD ALLOY WITH REVERSIBLE HARDNESS CHARACTERISTICS

[75] Inventors: Dwarika P. Agarwal, Attleboro; Grigory Raykhtsaum, Norton, both of Mass.

[73] Assignee: Leach & Garner Company, North Attleboro, Mass.

[21] Appl. No.: 08/968,813

[22] Filed: Nov. 17, 1997

[51] Int. Cl.[6] ..... C22C 27/06; C22C 5/02

[52] U.S. Cl. ..... 148/405; 148/430; 420/508

[58] Field of Search ..... 148/405, 430; 420/508; C22C 5/02

[56] References Cited

U.S. PATENT DOCUMENTS

| | | | |
|---|---|---|---|
| 2,050,077 | 8/1936 | Wise | 420/508 |
| 3,981,723 | 9/1976 | Tuccillo | 420/508 |
| 4,869,757 | 9/1989 | Eagar et al. | 148/405 |
| 5,173,132 | 12/1992 | Solomon | 148/405 |
| 5,180,551 | 1/1993 | Agarwal | 148/405 |
| 5,240,172 | 8/1993 | Steinke et al. | 420/508 |
| 5,384,089 | 1/1995 | Diamond | 420/511 |
| 5,423,680 | 6/1995 | Prasad | 420/507 |
| 5,462,437 | 10/1995 | Prasad et al. | 420/508 |

FOREIGN PATENT DOCUMENTS 09-137240 5/1997 Japan .

OTHER PUBLICATIONS

Pinasco et al in PRAKT. METALLOGR. (1988), 25 7, 330–339.

*Primary Examiner*—Sikyin Ip
*Attorney, Agent, or Firm*—Phillips, Lytle, Hitchcock, Blaine & Huber LLP

[57] ABSTRACT

A hardenable white gold alloy consists essentially of about 55–60 % gold, about 12–20% silver, about 8–15% copper, about 8–18% palladium, about 0.0–1.0% tin, zinc indium or cobalt, and, optionally, about 0.005–0.02% iridium and/or ruthenium, and also about 0.01–0.03 weight percent lithium. The alloy is nickel-free, but has a pleasing white color similar to that of nickel-containing white gold alloys. The alloy has a fine grain structure, a lower hardness in its annealed condition, but is capable of being hardened to an exceptional hardness value. The hardening procedure is reversible.

20 Claims, No Drawings

NICKEL-FREE WHITE GOLD ALLOY WITH REVERSIBLE HARDNESS CHARACTERISTICS

TECHNICAL FIELD

The present invention relates generally to the field of gold alloys, and, more particularly, to improved white gold alloys that do not contain nickel, that have a desirable color, and that are capable of being selectively hardened and softened by appropriate heat treatment processes.

BACKGROUND ART

Gold-based alloys have been used for centuries in the manufacture of jewelry. The most common of these are of 14 karat composition, and have a traditional yellow color. However, for certain applications, such as diamond settings, a white gold alloy is preferred. Traditionally, white jewelry alloys contained platinum. However, during World War II, platinum was considered to be a strategic industrial metal, and its usage in jewelry items was therefore limited. Platinum was replaced by white-colored gold alloys. Even after the war, white-colored gold alloys remained popular as an alternative to platinum-containing alloys.

A number of elements have been tried to bleach the color of gold, but, upon information and belief, only alloys containing palladium and nickel have been successful. The main drawbacks of palladium-containing gold alloys are their high cost and high melting temperature. Additionally, these alloys become very soft when exposed to a soldering operation. Nickel can produce an allergic reaction. Moreover, nickel-containing alloys appear to be more prone to stress corrosion cracking, which may, for example, lead to a prong failure in a diamond setting. These properties are discussed in U.S. Pat. Nos. 5,372,779 and 5,635,131, the aggregate disclosures of which is hereby incorporated by reference.

U.S. Pat. No. 3,981,723 discloses a white gold alloy consisting essentially of about 50–54% gold, about 27–31% palladium, about 11–16% silver, about 4.5–8% indium and tin, and about 0.05–2.5% iridium or ruthenium. These alloys are intended for use in dental applications, and have unsuitably high melting temperatures, high costs, and excessive amounts of palladium.

U.S. Pat. No. 5,372,779 discloses a nickel-free white gold alloy containing about 35–50% gold, about 35–63% silver, about 0.0–7.0% zinc and/or germanium, and less than about 9% palladium. These alloys are apparently intended for 10 karat gold applications, and do not appear to provide reversible hardness characteristics.

U.S. Pat. No. 5,635,131 discloses a palladium-containing white gold alloy containing about 58.33% gold, about 29% silver and about 2.67% zinc. This alloy does not appear to have the reversible hardness characteristics of the present invention.

Finally, U.S. Pat. No. 5,180,551, which is assigned to the assignee of the present invention, discloses a yellow gold alloy capable of reversible hardness. The alloy contains not less than about 58.03% gold, not less than about 10% silver, not less than 2% zinc, not less than 0.2% cobalt, and copper in a weight percent amount equal to 100 less the sum total of the weight percent of the gold, silver, zinc and cobalt. The ratio of the copper amount to the silver amount being between about 2.0 and about 3.8. The ratio of the copper amount to the sum total of the silver amount plus twice the zinc amount is between about 1.3 and about 2.5. The composition has a desirable gold color which has a yellow component in the range of about 17.7 to about 20.5 CIE units, and a red component in the range of about 2.6 to about 4.0 CIE units. This composition is also capable of being selectively hardened to at least 150% of its annealed hardness.

Accordingly, it would be desirable to provide an improved white gold alloy having many of these same properties.

DISCLOSURE OF THE INVENTION

The present invention broadly provides an improved reversibly-hardenable nickel-free gold-based alloy composition, which consists essentially of: about 55–60 weight percent gold, about 12–20 weight percent silver, about 8–15 weight percent copper, about 8–18 weight percent palladium, and about 0.0–1.0 weight percent selected from a group consisting of tin, zinc, indium and cobalt. The composition has a yellow component of less than about 12 CIE b* units and a red component of less than about 2.3 CIE a* units, a hardness of about 180 VHN in an annealed condition caused by heating to about 650–820° C. for about 1 hour and quenching in water at room temperature, a hardness of at least about 250 VHN after heating to a temperature of about 260–400° C. for about 1–4 hours in a protective atmosphere, such as nitrogen, hydrogen or a mixture thereof, to prevent oxidation, and a melting point of less than about 1100° C. The composition may additionally include about 0.005–0.02 weight percent iridium and/or ruthenium, and also 0.01–0.03 weight percent lithium.

A preferred composition consists essentially of: about 58.5 weight percent gold, about 12–20 weight percent silver, about 8–15 weight percent copper, about 8–18% weight percent palladium, about 0.0–1.0 weight percent zinc, about 0.0–1.0 weight percent cobalt, and about 0.1–1.0 weight percent selected from a group consisting of tin and indium.

A more preferred composition consists essentially of: about 58.5 weight percent gold, about 12–20 weight percent silver, about 8–15 weight percent copper, about 8–18 weight percent palladium, about 0.0–1.0 weight percent zinc, about 0.0–1.0 weight percent cobalt, about 0.1–1.0 weight percent of an element selected from the group consisting of tin and indium, about 0.005–0.02 weight percent iridium and/or ruthenium, and about 0.01–0.03 weight percent lithium.

Accordingly, a general object of the present invention is to provide a new and improved nickel-free white gold alloy.

Another object is to provide an improved white gold alloy that has a white gold color with a yellow component of less than about 12 CIE b* units, and a red component of less than about 2.3 CIE a* units.

Another object is to provide such an alloy that has a capability of having a maximum hardness of about 180 VHN in an annealed condition, which can be produced by heating the alloy to about 820° C. and quenching.

Another object is to provide such an alloy that can be heat treated to selectively increase the hardness of the alloy to about 250 VHN or greater, with the heat treatment process being carried out by heating the sample to a temperature of about 400° C. for 1–4 hours in a protective atmosphere.

Still another object is to provide such an alloy with the melting point being below about 1100° C.

These and other objects and advantages will become apparent from the foregoing and ongoing written specification, the drawings and the appended claims.

DESCRIPTION OF THE PREFERRED EMBODIMENTS

As used herein, "VHN" refers to Vickers Hardness Number, "$VHN_{ann}$" refers to the Vickers Hardness Number in an annealed condition, "$VHN_{aged}$" refers to the Vickers Hardness Number in an aged condition, "CIE" refers to the CIELAB color coordinates as reported in "Standard Test Method for Calculation of Color Differences From Instrumentally Measured Color Coordinates", ASTM Standard D2244-89, Annual Book of ASTM Standards, Vol. 06.01", and as applied in D. P. Agarwal and G. Raykhtsaum, "The Color of Gold: The New Gold Color Reference Kit Takes the Guesswork Out of Describing Gold Color", AJM (October 1994), and "a*" and "b*" refer the red and yellow coordinates, respectively, on this CIELAB system.

The present invention broadly provides an improved reversibly-hardenable nickel-free gold-based alloy composition, which consists essentially of: about 55–60 weight percent gold, about 12–20 weight percent silver, about 8–15 weight percent copper, about 8–18 weight percent palladium, and about 0.0–1.0 weight percent selected from a group consisting of tin, zinc, indium and cobalt. The composition has a yellow component of less than about 12 CIE b* units and a red component of less than about 2.3 CIE a* units, a hardness of about 180 VHN in an annealed condition caused by heating to about 820° C. and quenching, a hardness of at least about 250 VHN after heating to a temperature of about 400° C. for about 1–4 hours in a protective atmosphere, and a melting point of less than about 1100° C. The composition may additionally include about 0.005–0.02 weight percent iridium and/or ruthenium, and also about 0.01–0.03 weight percent lithium. Additions of iridium and ruthenium to this basic composition may be required to reduce the grain size and to eliminate the "orange peel" effect. It may be desirable to add lithium to reduce the porosity, and to provide the jewelry with a better finish.

A preferred composition consists essentially of: about 58.5 weight percent gold, about 12–20 weight percent silver, about 8–15 weight percent copper, about 8–18 weight percent palladium, about 0.0–1.0 weight percent zinc, about 0.0–1.0 weight percent cobalt, and about 0.1–1.0 weight percent selected from a group consisting of tin and indium.

The compositions and properties of several alloys are comparatively summarized in tables 1 and 2 below. In Table 1, the various alloys are severally indicated as alloy 1, alloy 2, . . . alloy n, and the composition of each alloy is indicated by the percentage amounts of the indicated elements. For example, alloy 13 contains 58.50% gold, 19.00% silver, 12.00% palladium, 10% copper, 0.25% indium, and 0.25% tin, and so on.

TABLE 1

| Alloy Compositions | | | | | | | |
|---|---|---|---|---|---|---|---|
| Alloy | Au % | Ag % | Pd % | Cu % | Zn % | Ni % | Other % |
| 1 | 58.50 | | | 29.73 | 5.00 | 6.77 | |
| 2 | 58.50 | 31.06 | 9.49 | | 0.95 | | |
| 3 | 58.50 | 18.25 | 5.00 | 18.25 | | | |
| 4 | 58.50 | 18.25 | 18.25 | 5.00 | | | |
| 5 | 58.50 | 15.75 | 10.00 | 15.75 | | | |
| 6 | 58.50 | 15.00 | 15.00 | 10.00 | 1.50 | | |
| 7 | 58.50 | 13.25 | 15.00 | 13.25 | | | |
| 8 | 58.50 | 16.00 | 15.00 | 10.00 | 0.50 | | |
| 9 | 58.50 | 19.25 | 12.25 | 10.00 | | | |
| 10 | 58.50 | 19.00 | 12.00 | 10.00 | 0.50 | | |
| 11 | 58.50 | 19.00 | 12.00 | 10.00 | | | 0.50 In |
| 12 | 58.50 | 19.00 | 12.00 | 10.00 | | | 0.50 Sn |
| 13 | 58.50 | 19.00 | 12.00 | 10.00 | | | 0.25 In<br>0.25 Sn |
| 14 | 58.50 | 19.00 | 12.00 | 10.00 | | | 0.50 Co |
| 15 | 58.50 | 19.00 | 12.00 | 9.99 | | | 0.25 In |

TABLE 1-continued

| Alloy Compositions | | | | | | | |
|---|---|---|---|---|---|---|---|
| Alloy | Au % | Ag % | Pd % | Cu % | Zn % | Ni % | Other % |
| | | | | | | | 0.25 Sn<br>0.01 Ir |
| 16 | 58.50 | 19.00 | 11.99 | 10.00 | | | 0.25 In<br>0.25 Sn<br>0.01 Ru |
| 17 | 58.50 | 18.98 | 12.00 | 10.00 | | | 0.25 In<br>0.25 Sn<br>0.25 Li |
| 18 | 58.50 | 18.97 | 12.00 | 10.00 | | | 0.25 In<br>0.25 Sn<br>0.02 Li<br>0.01 Ir |

The various alloys listed in Table 1 have been determined to have the properties listed in Table 2. Thus, for example, alloy 13 has a red component of a*=1.4, a yellow component of b*=8.8, an annealed hardness of 175 VHN, an aged hardness of 290 VHN, a solidus temperature of 962° C. and a liquidus temperature of 1043° C., and so on.

TABLE 2

| Alloy Properties | | | | | | |
|---|---|---|---|---|---|---|
| | Color | | Hardness | | Temperatures | |
| Alloy | a* | b* | $HVN_{ann}$ | $HVN_{aged}$ | Solidus °C. | Liquidus °C. |
| 1 | 2.3 | 9.7 | 160 | 160 | 945 | 996 |
| 2 | 0.5 | 12.0 | 130 | 130 | 1078 | 1150 |
| 3 | 3.3 | 14.0 | 205 | 320 | 883 | 922 |
| 4 | 1.2 | 7.7 | 120 | 135 | 1114 | 1183 |
| 5 | 2.2 | 9.8 | 195 | 320 | 935 | 992 |
| 6 | 1.3 | 9.8 | 190 | 340 | 1006 | 1072 |
| 7 | 1.1 | 7.3 | 170 | 275 | 1000 | 1076 |
| 8 | 1.3 | 8.0 | 160 | 285 | 1017 | 1094 |
| 9 | 1.7 | 10.0 | 155 | 270 | 988 | 1064 |
| 10 | 1.2 | 9.6 | 165 | 290 | 981 | 1055 |
| 11 | 1.4 | 8.8 | 170 | 275 | 959 | 1047 |
| 12 | 1.4 | 8.9 | 175 | 315 | 963 | 1037 |
| 13 | 1.4 | 8.8 | 175 | 290 | 962 | 1043 |
| 14 | 1.2 | 7.8 | 165 | 285 | 991 | 1074 |
| 15 | 1.4 | 8.8 | 175 | 290 | 962 | 1043 |
| 16 | 1.4 | 8.8 | 175 | 290 | 962 | 1043 |
| 17 | 1.4 | 8.8 | 175 | 290 | 962 | 1043 |
| 18 | 1.4 | 8.8 | 175 | 290 | 962 | 1043 |

Alloy 1 is a commercially-available nickel-containing 14 karat white gold alloy. The red component (a*=2.3) appears to be high enough to be noticed by the human eye as having a reddish tint. The yellow component (b*=9.7) appears to be typical for white golds. The red component can be reduced by increasing the nickel content. This, in turn, makes the alloy harder and more difficult to work. In addition, the higher nickel content leads to the rise of the melting range. This alloy does not have reversible hardness characteristics. Alloy 1 actually establishes the acceptable upper limit for the red color component (a*).

Alloy 2 is a commercially-available palladium-containing alloy. It does not contain copper, and it appears to have an acceptable red color component (a*=0.5). The yellow component (b*=12) makes this alloy appear somewhat yellowish to the human eye. The yellow color component (b*) can be decreased by increasing the palladium content, albeit with a corresponding increase in cost. Higher palladium content leads to a substantial increase in the already-high melting range. As with alloy 1, alloy 2 does not have a reversible hardness characteristic. Alloy 2 actually establishes the acceptable upper limit for the yellow color component (b*).

Alloy 3 is a low palladium (5%) and high copper (18.25%) containing alloy. The properties of this alloy show that 5% palladium is not enough to achieve an acceptable color (i.e., the alloy is too red and too yellow), and is hard in the annealed condition.

Alloy 4 is a high palladium (18.25%) and low copper (5%) containing alloy. This alloy shows that by reversing the PD/Cu ration with respect to alloy 3, the acceptable color can be achieved in copper-containing white gold alloys. However, this alloy does not show the reversible hardness characteristic, and its melting range is too high.

Alloy 5 contains 10% palladium and 15.75% copper. This composition results in the acceptable color, with the red component approaching the upper limit. This alloy show a reversible hardness characteristic. However, the alloy appears to be too hard in the annealed condition.

Alloy 6 shows that increasing palladium to 15%, reducing copper to 10%, and adding 1.5% zinc, improves the white color with respect to alloy 5. However, this alloy is too hard in the annealed condition.

Alloy 7 contains 15% palladium and equally-divided silver and copper concentrations. This alloy shows an acceptable color, has the reversible hardness characteristic, and has an acceptable melting range. This is actually the first alloy in the series of acceptable alloys according to the data provided in the Tables.

Alloy 8 contains 15% palladium, the same as in alloy 7. The copper content in this alloy is decreased to 10%, the silver content is increased to 16%, and 0.5% zinc is added. The addition of 0.5% zinc somewhat enhanced the hardness in the aged condition. This alloy possesses acceptable properties.

Alloy 9 is a 12.25% palladium-containing alloy. As with alloy 8, the copper content is kept at 10%. This alloy shows that even at palladium concentrations as low as 12.25%, and copper concentrations as high as 10%, the color still stays well within the acceptable limits for a* and b*. The reversible harness and melting range characteristics are also acceptable.

Alloys 10–14 show that at palladium concentrations of about 12% and copper concentrations of about 10%, the additions of 0.5% of such elements as zinc, indium, tin and cobalt enhance the hardness of the alloy in the aged condition, and reduce the a* component with respect to alloy 9. Zinc, indium and tin also act as deoxidizers in these alloys. The addition of 0.5% tin results in the highest aged hardness and the lowest liquidus temperature among alloys 9–14.

Alloys 15–18 use the same base composition as alloy 13, except for additions of iridium, ruthenium, lithium or a combination of these elements. These small, but important, additions do not change the major properties of the alloy. However, they do provide an improved product with a finer gain structure and a better finish on the surface.

Therefore, while a preferred compositions of the improved alloys have been shown and described, and various modifications thereof discussed, persons skilled in this art will readily appreciate that various additional changes and modifications may be made without departing from the spirit of the invention, as defined and differentiated in the following claims.

What is claimed is:

1. A hardenable nickel-free gold-based alloy composition, consisting essentially of:

about 55–60 weight percent gold;

about 12–20 weight percent silver;

about 8–15 weight percent copper;

about 12–18 weight percent palladium;

about 0.1–1.0 weight percent selected from the group consisting of tin and indium; and up to 0.5 weight percent cobalt.

2. A hardenable nickel-free gold-based alloy composition as set forth in claim 1 wherein said composition has a yellow component of less than about 12 CIE b* units and a red component of less than about 2.3 CIE a* units.

3. A hardenable nickel-free gold-based alloy composition as set forth in claim 1 wherein the composition has a hardness of about 180 VHN in an annealed condition caused by heating to about 820° C. for about 1 hour and quenching in water at room temperature.

4. A hardenable nickel-free gold-based alloy composition as set forth in claim 1 wherein the composition has a hardness of greater than about 250 VHN after heating to a temperature of about 400° C. for about 1–4 hours in a protective atmosphere to prevent oxidation.

5. A hardenable nickel-free gold-based alloy as set forth in claim 1 wherein said composition has a melting point of less than about 1100° C.

6. A hardenable nickel-free gold-based alloy composition as set forth in claim 1, and further consisting essentially of:

about 0.005–0.02 weight percent iridium and/or ruthenium.

7. A hardenable nickel-free gold-based alloy composition as set forth in claim 6 wherein said composition has a yellow component of less than about 12 CIE b* units and a red component of less than about 2.3 CIE a* units.

8. A hardenable nickel-free gold-based alloy composition as set forth in claim 6 wherein the composition has a hardness of less than about 180 VHN in an annealed condition caused by heating to about 820° C. for about 1 hour and quenching in water at room temperature.

9. A hardenable nickel-free gold-based alloy composition as set forth in claim 6 wherein the composition has a hardness of greater than about 250 VHN after heating to a temperature of about 400° C. for about 1–4 hours in a protective atmosphere to prevent oxidation.

10. A hardenable nickel-free gold-based alloy as set forth in claim 6 wherein said composition has a melting point of less than about 1100° C.

11. A hardenable nickel-free gold-based alloy as set forth in claim 6, and further consisting essentially of about 0.01–0.03 weight percent lithium.

12. A hardenable nickel-free gold-based alloy composition as set forth in claim 11 wherein said composition has a yellow component of less that about 12 CIE b* units and a rec component less than about 2.3 CIE a* units.

13. A hardenable nickel-free gold-based alloy composition as set forth in claim 11 wherein said composition has a hardness of less than 180 VHN in an annealed condition caused by heating to about 820° C. for about 1 hour and quenching in water at room temperature.

14. A hardenable nickel-free gold-based alloy composition as set forth in claim 11 wherein the composition has a hardness of greater than about 250 VHN after heating to a temperature of about 400° C. for about 1–4 hours in a protective atmosphere to prevent oxidation.

15. A hardenable nickel-free gold based alloy composition as set forth in claim 11 wherein said composition has a melting point of less than about 1100° C.

16. A hardenable nickel-free gold-based alloy composition, consisting essentially of:

about 58.5 weight percent gold;

about 12–20 weight percent silver;

about 8–15 weight percent copper;

about 12–18 weight percent palladium;

about 0.0–1.0 weight percent zinc;

up to 0.5 weight percent cobalt;

about 0.1–1.0 weight percent selected from the group consisting of tin and indium;

about 0.0–0.02 weight percent iridium;

about 0.0–0.02 weight percent ruthenium; and about 0.0–0.03 weight percent lithium.

17. A hardenable nickel-free gold-based alloy composition as set forth in claim 16 wherein said composition has a yellow component of less than about 12 CIE b* units and a red component of less than about 2.3 CIE a* units.

18. A hardenable nickel-free gold-based alloy composition as set forth in claim 16 wherein the composition has a hardness of less than about 180 VHN in an annealed condition caused by heating to about 820° C. for about 1 hour and quenching in water at room temperature.

19. A hardenable nickel-free gold-based alloy composition as set forth in claim 16 wherein the composition has a hardness of greater than about 250 VHN after heating to a temperature of about 400° C. for about 1–4 hours in a protective atmosphere.

20. A hardenable nickel-free gold-based alloy composition as set forth in claim 16 wherein said composition has a melting point of less than about 1100° C.

* * * * *